US005203502A

United States Patent [19]

Young

[11] Patent Number: 5,203,502

[45] Date of Patent: Apr. 20, 1993

[54] RIBBED ELASTOMERIC RAIL PAD

[75] Inventor: Hartley F. Young, Melton, Australia

[73] Assignee: McKay Australia Limited, Maidstone, Australia

[21] Appl. No.: 891,687

[22] Filed: May 29, 1992

Related U.S. Application Data

[63] Continuation of Ser. No. 534,937, Jun. 8, 1990, abandoned.

[30] Foreign Application Priority Data

Jun. 9, 1989 [AU] Australia ..... PJ4636

[51] Int. Cl.[5] ..... E01B 9/68

[52] U.S. Cl. ..... 238/283; 238/264; 238/306

[58] Field of Search ..... 238/107, 264, 265, 283, 238/284, 285, 301, 302, 306, 307, 382

[56] References Cited

U.S. PATENT DOCUMENTS

| | | | |
|---|---|---|---|
| 2,377,942 | 6/1945 | Johnson | 238/283 |
| 3,827,631 | 8/1974 | Kirik | 238/283 |
| 3,904,112 | 9/1975 | Thim et al. | 238/265 X |
| 3,920,183 | 11/1975 | Houghton | 238/283 |
| 4,175,700 | 11/1979 | Gehrke | 238/349 X |
| 4,316,578 | 2/1982 | Reynolds et al. | 238/264 X |
| 4,618,093 | 10/1986 | Young et al. | 238/351 X |
| 4,757,945 | 7/1988 | Leeves | 238/382 X |
| 4,771,944 | 9/1988 | Brister et al. | 238/283 |
| 4,773,591 | 9/1988 | Sonneville | 238/265 X |
| 4,971,247 | 11/1990 | Harkus | 238/306 X |

*Primary Examiner*—Michael S. Huppert
*Assistant Examiner*—James Keenan
*Attorney, Agent, or Firm*—Hodgson, Russ, Andrews, Woods & Goodyear

[57] ABSTRACT

A rail fastening of the kind in which a rail, having a field edge and a gauge edge is fastened to a rail tie by a rail seat including a rail, a rail tie and a rail pad between the tie and the rail, a pair of rail clamp supports secured to the tie on either side of the rail and abutting the rail pad, and a rail clamp associated with each rail clamp support and each clamp having a portion secured in the clamp support and a portion bearing down on the rail flange. The rail pad electrically and dynamically insulates the rail tie from the rail and there is a rib provided on the field edge portion of the rail pad to reduce the intensity of the pressure on the pad under the field edge of the rail.

11 Claims, 3 Drawing Sheets

RIBBED ELASTOMERIC RAIL PAD

This application is a continuation, of application Ser. No. 07/534,937, filed June 8, 1990, now abandoned.

This invention relates to improvements in rail insulating pads which are used to electrically and dynamically insulate the rail from the rail tie.

Many rail pad constructions have been proposed to provide the necessary insulation and to protect the rail ties from damage and the rail seal from instability. U.K. Patents 2,154,635 and 2,152,119 provide pads of relatively hard material which provide, by way of selective removal of material from the pads, good attenuation and rail stability.

However, improved durability of rail pads is a long sought after advantage.

In curved track the rail head is subject to the vertically down gravity forces from the rolling stock and in addition, horizontal centrifugal forces. These combine to impart a rolling tendency to the rail which is resisted by the rail fasteners and the pad beneath the rail.

These forces cause a pressure on the rail pad which is greatest under the field edge of the rail which often causes this edge to cut into the soft rail pad and in some extreme cases, to cut it right through.

The field edge is the outside edge of the rail in a track formed by a pair of rails. The inside edge is referred to as the gauge side or gauge edge of the rail.

It is an object of this invention to provide a rail pad having improved durability.

To this end the present invention provides a rail pad to electrically and dynamically insulate a rail from the rail tie in which the rail pad incorporates an upstanding rib on either or both the upper and lower surface of said pad on the field edge side of said pad.

This invention is a way to reduce the intensity of the pressure under the field edge of the rail thereby prolonging the life of the elastomeric rail pad. This is done by providing a ridge on the field edge of the pad which runs parallel to the length of the rail and is located with the edge a short distance away from the rail edge towards the rail centre. Preferably the ridge may be about 10 mm wide with the edge approximately 10 mm from the field edge of the rail. The rib is preferably about 1 or 1.5 mm high and is preferably of a material which is compressed flat by the load of the rail and in so doing, creates a higher than normal pressure in the region of the rib which then subtracts some of the load from the region of the pad directly underneath the rail edge thereby causing a reduced pressure in this region with the consequent reduction in the tendency for the rail edge to cut the pad. Of course the increased pressure in the proximity of the pad does not create a cutting tendency since there is no edge in this area.

The rib should have a low height, preferably 1 to 1.5 mm so that under the load of the installed rail fastening clips it compresses down to the general level of the remainder of the pad thereby ensuring that the rib does not carry the total load and also to ensure that the pad's peripheral edges are in contact with the concrete rail seat and rail to ensure an adequate seal to prevent the ingress of damaging abrasive grit particles.

The rib can be placed either on the top side of the pad or on the bottom or alternatively, distributed between both top and bottom. However, the preferred position is on top to minimize the risk of dust entering between the pad and concrete rail face.

Although most situations call for the rib to be on the field edge of the pad where the function is normally required, in some unusual situations where the track is canted and the traffic travelling around the curve is moving slower than the designed speed for the cant, the rail head can receive a lateral force by the gravity component which exceeds the centrifugal component giving a net force towards the centre of the curve. For this reason the rib is preferably applied to both the field and gauge sides which has the additional benefit of making the pad less susceptible to being installed the incorrect way around.

A preferred embodiment of this invention will now be described with respect to the drawings in which FIG. 1 is a general schematic view of a rail seat illustrating the position of the rail pad;

Figure 4A:
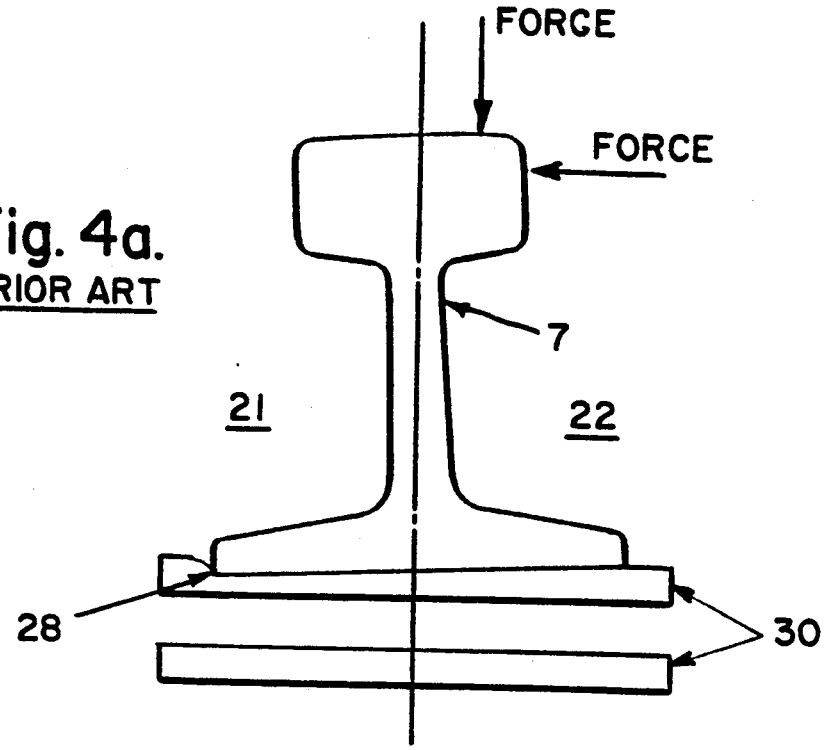
Fig. 4a. PRIOR ART
Figure 4B:
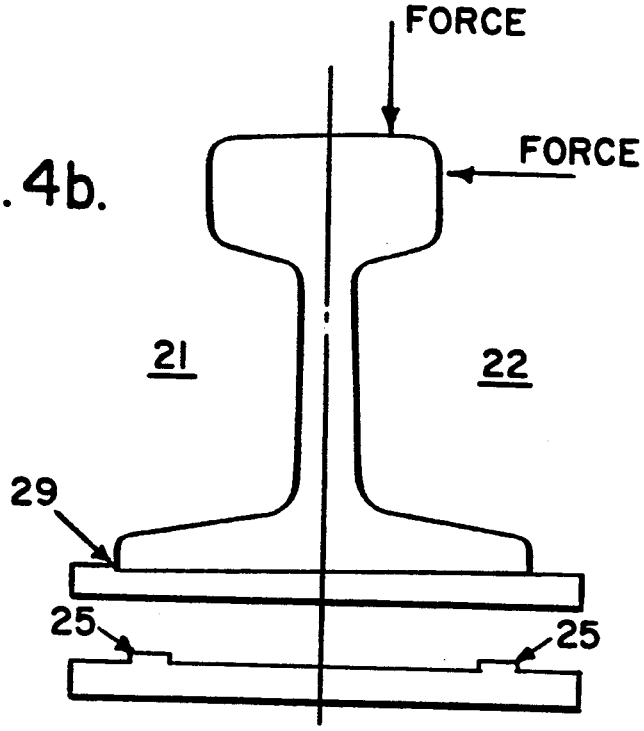

FIGS. 4A and 4B provide a comparison of the standard prior art pads and the pads of this invention.

Figure 1:
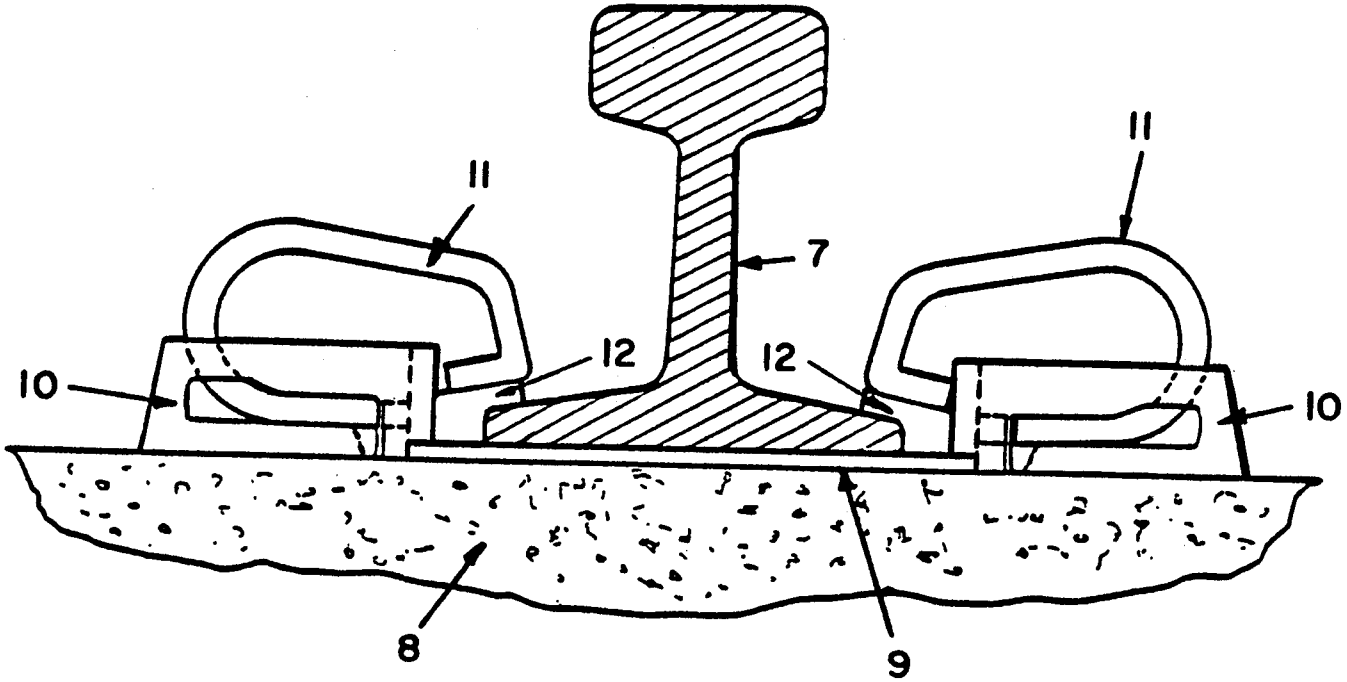

In FIG. 1 the rail seat comprises a rail 7, a rail tie 8 and the rail pad 9 interposed between them. The rail is fastened by the rail clips 11 seated in the clip holders 10 embedded in rail tie 8. An insulator 12 lies between the rail 7 and the fastener 11.

Figure 2:
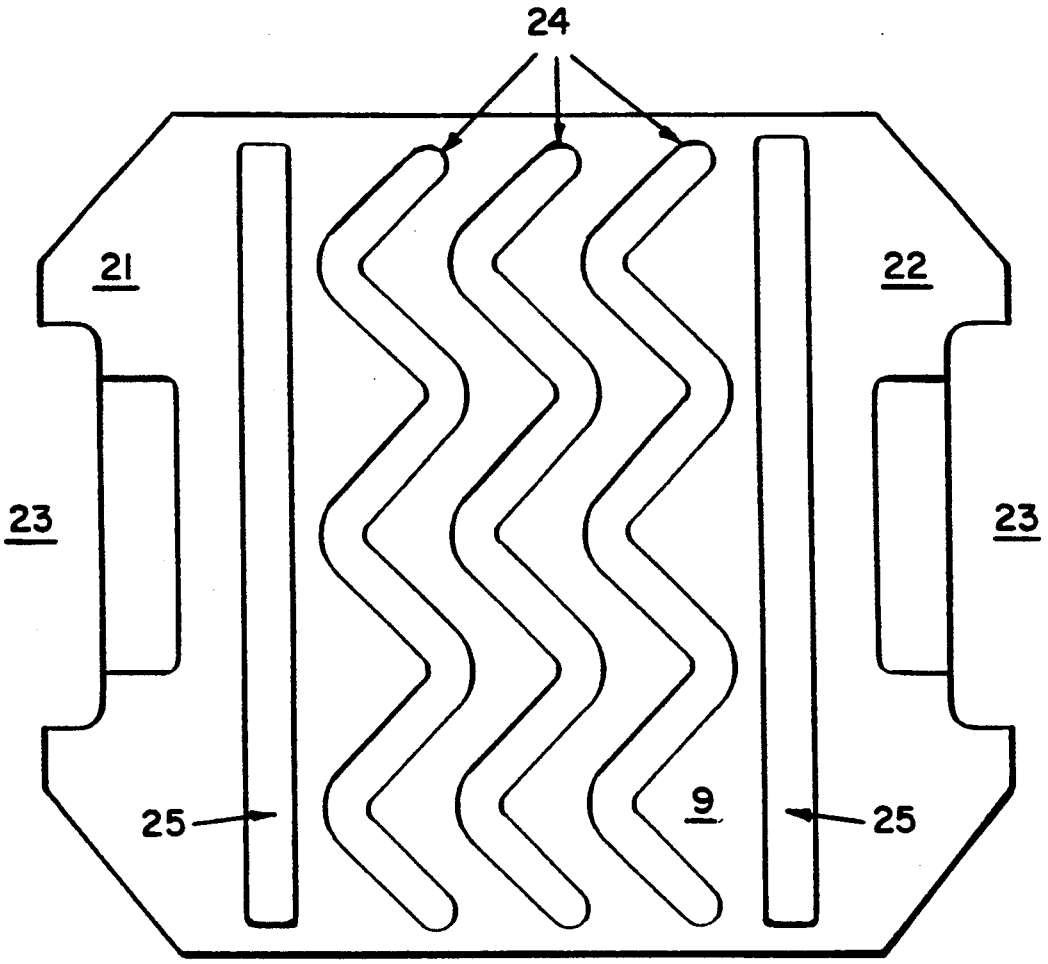
FIG. 2 is a plan view of a preferred form of the invention.
Figure 3:
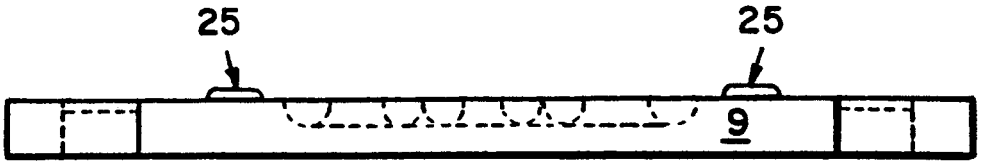
FIG. 3 is an edge view of the pad.

In FIGS. 2 and 3 the rail pad 9 comprises field side 21 and gauge side 22 with the edge recesses 23 to fit about the clip holders 10. Grooves 24 are provided in the surface of the pad to improve force attenuation. The low ribs 25 are each about 1 mm in height and are designed to lie under the rail within 10 mm of the field and gauge edges of the rail.

In FIG. 4A a standard rail pad 30 is shown under a rail 7. The arrows on the rail head indicate the direction of forces imposed on the rail by the passing rail trucks. The arrow 28 on the field side 21 of the rail pad shows deep indentation underload which leads to cutting of the pad along the field edge of the rail. In FIG. 4B a pad 9 of this invention shows reduced indentation 29 on the field edge due to the provision of ribs 25. There is also less roll by the rail with consequent improved stability.

From the above description, it can be seen that the present invention provides an improved rail pad with enhanced durability.

We claim:

1. In a rail seat of the kind in which a rail having a flange, a field edge and a gauge edge is fastened to a rail tie by a pair of rail clamps which bear down on the flange of said rail and on rail clamp supports secured to said rail tie on either side of said rail such that a portion of said rail clamps eat in said rail clamp support, and wherein a wear resistant rail pad lies between the rail tie and the rail and said pad abuts said rail to electrically and dynamically insulate said rail tie from said rail, the improvement comprising said water resistant rail pad incorporating a rib extending longitudinally of said rail, said rib comprising a long raised structure upstanding from said rail pad surface and having a width relatively narrow in relation to the length thereof and said rib being provided on a surface of the field edge portion of the rail pad to reduce intensity of pressure on the pad under the region of the field edge of the rail to reduce the tendency of the rail to cut into the rail pad.

2. The improvement of claim 1 wherein said rib is of sufficient height to effect reduction of a force transmitted to said pad at said field edge of rail.

3. The improvement in any one of claims 1 or 2 wherein said rib is on the upper surface of said rail pad.

4. The improvement in any one of claims 1 or 2 wherein an additional rib is provided on the gauge edge portion of the pad.

5. The improvement of claim 1 wherein said rib is of a size and of a material such that when said rib is compressed by a load, a higher than normal pressure is created in the region of the rib which substrats a portion of the load from eh region of the pad directly underneath the rail edge.

6. The improvement of claims 1 or 2 wherein said rib is on the lower surface of said rail pad.

7. The improvement of claims 1 or 2 wherein said rib is on the upper surface of said rail pad and wherein another rib is provided on the lower surface of said rail pad.

8. A rail pad for electrically and dynamically insulating a rail tie from a rail wherein aid rail has a field edge and a gauge edge and said rail is fastened to said tie by means including a rail seat consisting of said rail, said rail tie and said rail pad between said tie and said rail and abutting said rail, and wherein there is a rib provided on a surface of the field edge portion of the rail pad, said rib comprising a long raised structure upstanding from said rail pad surface and having a width relatively narrow in relation to the length thereof and said rib extending lengthwise of the rail pad to reduce the intensity of the pressure on the pad under the region of the field edge of the rail to reduce the tendency of the rail to cut into the rail pad.

9. The rail pad as defined in claim 8 wherein the rib is parallel to said rail.

10. The rail pad as defined in claim 8 or claim 9 wherein an additional rib is provided on the gauge edge portion of the pad.

11. The improvement of claim 8 wherein said rib is of a size and of a material such that when said rib is compressed by a load, a higher than normal pressure is created in the region of the rib which subtracts a portion of the load from eh region of the pad directly underneath the rail edge.

* * * * *

UNITED STATES PATENT AND TRADEMARK OFFICE

CERTIFICATE OF CORRECTION

PATENT NO. : 5,203,502
DATED : April 20, 1993
INVENTOR(S) : Hartley F. Young

It is certified that error appears in the above-indentified patent and that said Letters Patent is hereby corrected as shown below:

Col. 2, line 53, change "eat" to --seat--.

Col. 3, line 10, change "eh" to --the--.

Col. 3, line 19, change "aid" to --said--.

Col. 4, line 20, change "eh" to --the--.

Signed and Sealed this

Fourth Day of January, 1994

Bruce Lehman

*Attest:*

BRUCE LEHMAN

*Attesting Officer*

*Commissioner of Patents and Trademarks*